US006543730B2

(12) United States Patent
Pedretti

(10) Patent No.: US 6,543,730 B2
(45) Date of Patent: Apr. 8, 2003

(54) PNEUMATIC STRUCTURAL ELEMENT

(76) Inventor: Mauro Pedretti, Via Miravalle 17, CH-6900 Lugano-Massagno (CH)

( * ) Notice: Subject to any disclaimer, the term of this patent is extended or adjusted under 35 U.S.C. 154(b) by 0 days.

(21) Appl. No.: 09/979,647

(22) PCT Filed: Feb. 19, 2001

(86) PCT No.: PCT/CH01/00107

§ 371 (c)(1),
(2), (4) Date: Feb. 8, 2002

(87) PCT Pub. No.: WO01/73245

PCT Pub. Date: Oct. 4, 2001

(65) Prior Publication Data

US 2002/0157322 A1 Oct. 31, 2002

(30) Foreign Application Priority Data

Mar. 27, 2000 (CH) ..... 583/00

(51) Int. Cl.[7] ..... E04H 5/20
(52) U.S. Cl. ..... 248/52; 213/248; 213/560
(58) Field of Search ..... 52/2.13, 2.18, 52/2.22, 2.23, 2.24, 2.11; 14/27, 2.6; 248/560, 562

(56) References Cited

U.S. PATENT DOCUMENTS 3,145,853 A * 8/1964 Langenberg ..... 52/2.11
3,894,307 A 7/1975 Delamare
4,712,335 A 12/1987 Barkdull, Jr.
5,421,128 A 6/1995 Sharpless et al.
5,677,023 A 10/1997 Brown
5,735,083 A 4/1998 Brown et al.
5,967,694 A * 10/1999 Covarrubias et al. ..... 404/28

FOREIGN PATENT DOCUMENTS

EP 0 647 751 A2 7/1994
FR 2 741 373 11/1995

* cited by examiner

*Primary Examiner*—Ramon O. Ramirez
(74) *Attorney, Agent, or Firm*—Jenkens & Gilchrist, P.C.

(57) ABSTRACT

The pneumatic structural component includes an essentially cylindrical airtight hollow body with radius $r_h$ and length $r_h$ and two caps, made from a flexible, but low-stretch, preferably textile material. The hollow body on its side exposed to the loading carries a pressure rod of length $L_h$, which is secured against sideways buckling and, at both its ends, carries a node. At least one pair of tension elements is joined to the pressure rod in the nodes. Tension elements run screw-shaped and contra-rotating in a whole number of circuits around the hollow body and intersect each other at positions, which lie on a surface line opposite to the pressure rod. The pressure rod, the surface line and the longitudinal axis of the hollow body, referenced A define a plane E in which the engaging loads and forces lie.

18 Claims, 6 Drawing Sheets

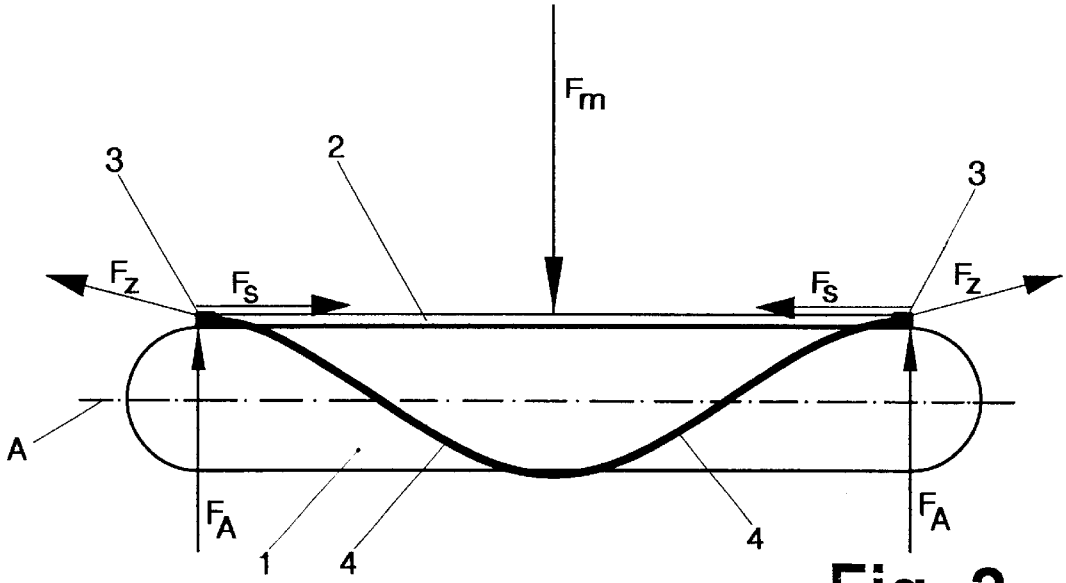
Fig. 2
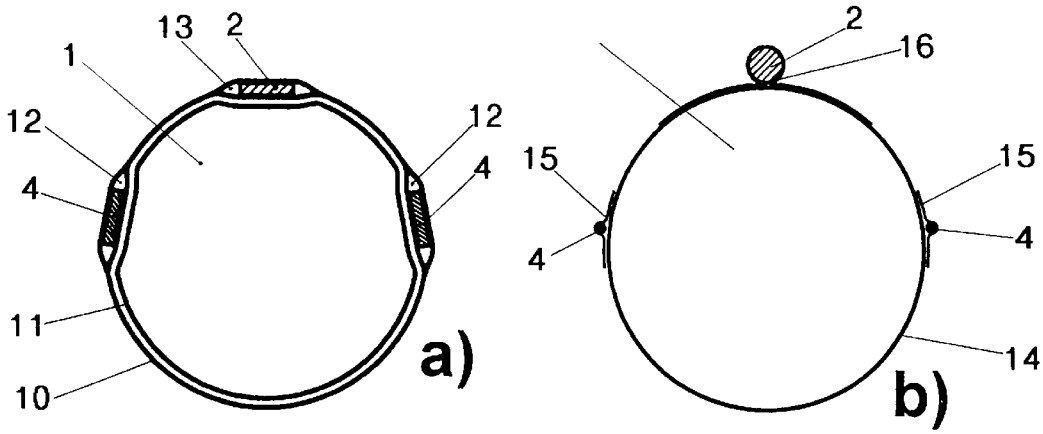
Fig. 3
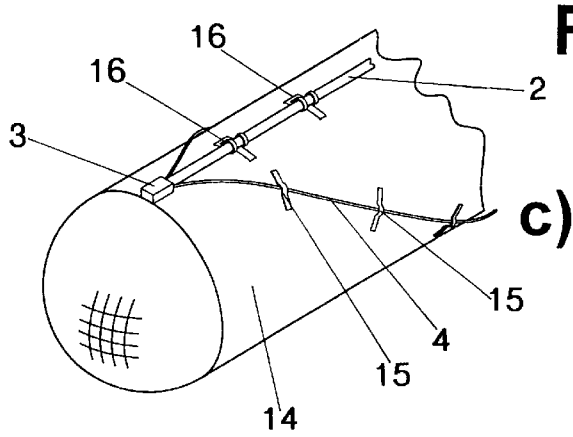

PNEUMATIC STRUCTURAL ELEMENT

The present invention relates to a pneumatic structural component.

Several pneumatic structural components in the form of inflatable tube shaped hollow bodies have become known, for example from U.S. Pat. Nos. 3,894,307 (D1), 4,712,335 (D2), 5,735,083 (D3), and FR 2,741,373 (D4). If such a component is loaded transversally, then the aim to be addressed lies principally in containing the tensional and shear forces, without the component collapsing. Whilst solutions are known primarily from D3 and D4, which can contain the tensile forces, in D1 and D2 solutions are published additionally for the containment of shear forces.

In D2 the shear forces are contained by numerous carbon fibre rods, which are held in tension between two separately constructed abutments—for instance from reinforced concrete. The pneumatic part of the components described there has the aim only of stabilising the pressure rods against primarily sideways buckling.

In D1 several of the components described are joined together parallel to each other into a bridge. The tensile forces are contained by cables led separately underneath, the shear forces by the bridge plates of elements set in rows against each other. Each element itself must here be secured against buckling to two further cables running parallel to the pneumatic elements.

In the documents closest to the present invention, D1, D2, arrangements are described which indeed have both tensile and shear elements, but are, however, very expensive both in production and also in application. Apart from this the individual pneumatic elements are only applied as holders of the separation between tensile and shear elements and could be replaced in this function by other light components. The aim of the present invention comprises the production of pneumatic structural components with tensile and shear elements, which can be produced simply and cost effectively, can be easily assembled to complex structural components and constructions such as roofs and bridges and whose erection can also be very quickly accomplished.

The addressing of this aim is given in the characterising part of claim 1 with regard to its essential features, in the following claims with regard to further advantageous features.

Figure 4:
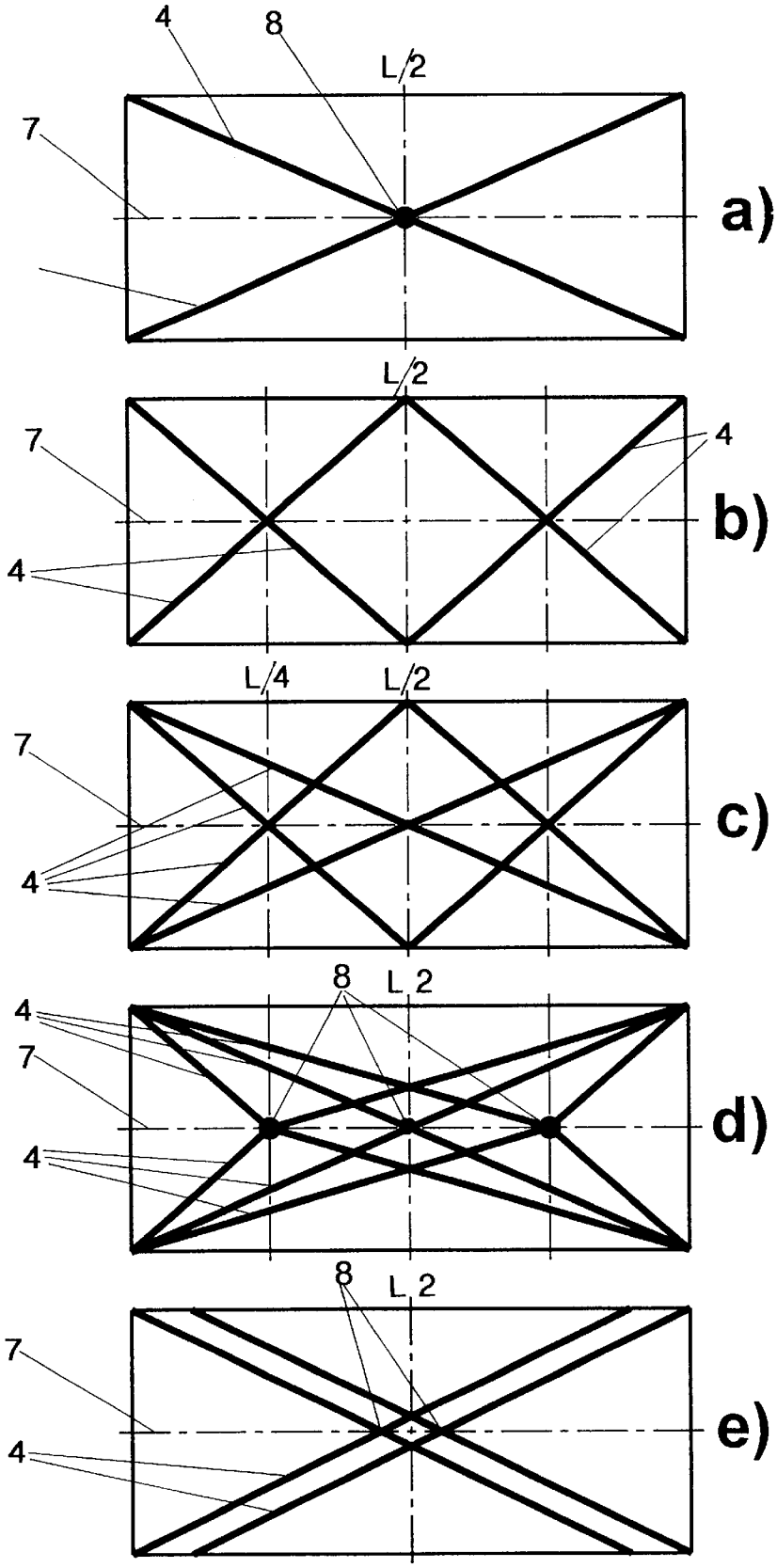
Figure 5:
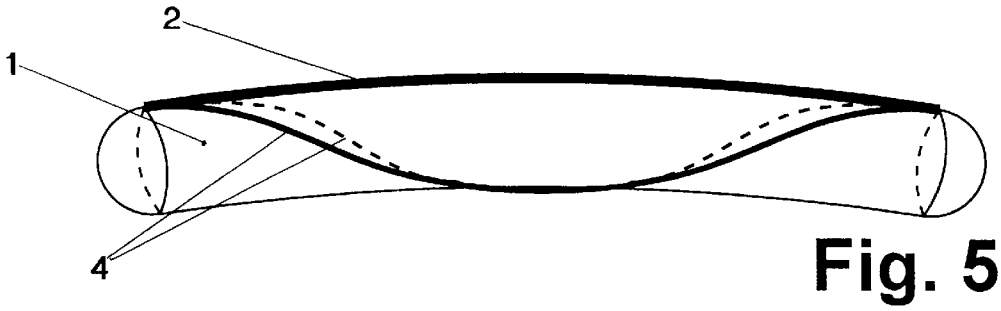
Figure 6:
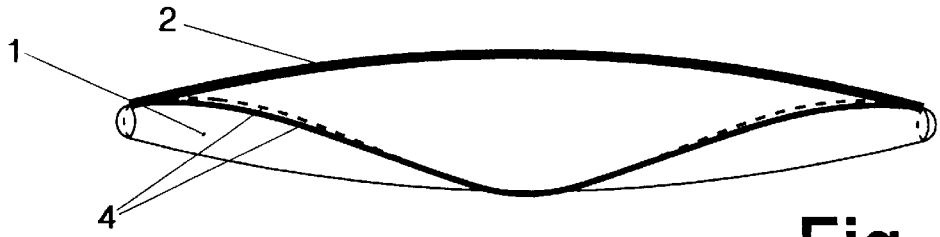
Figure 7:
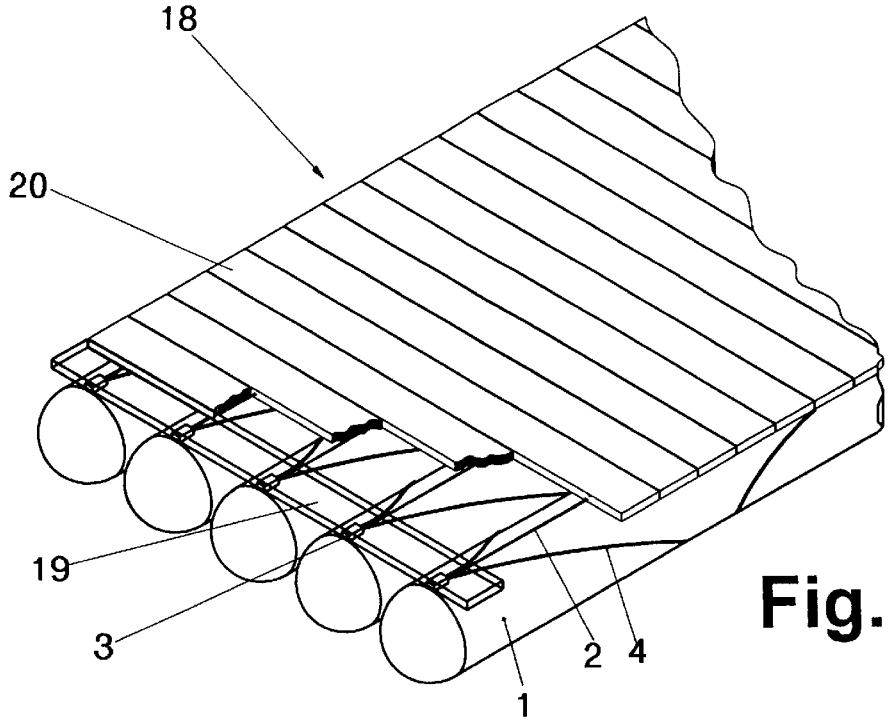
Figure 8:
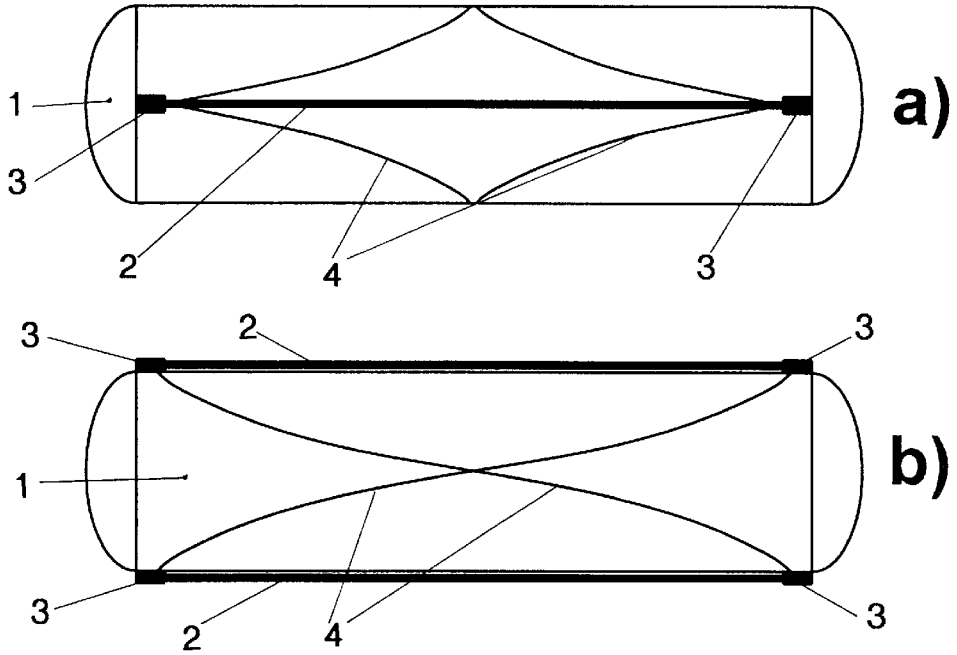
Figure 9:
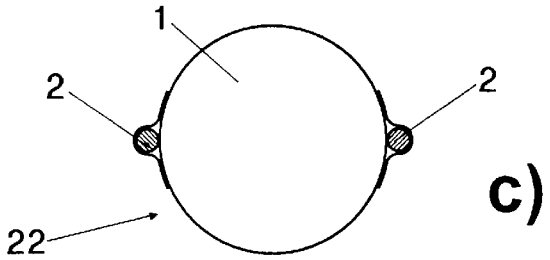
Figure 9:
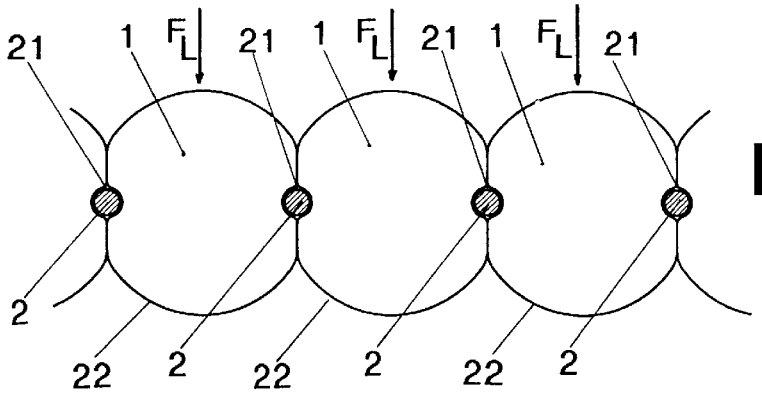
Figure 10:
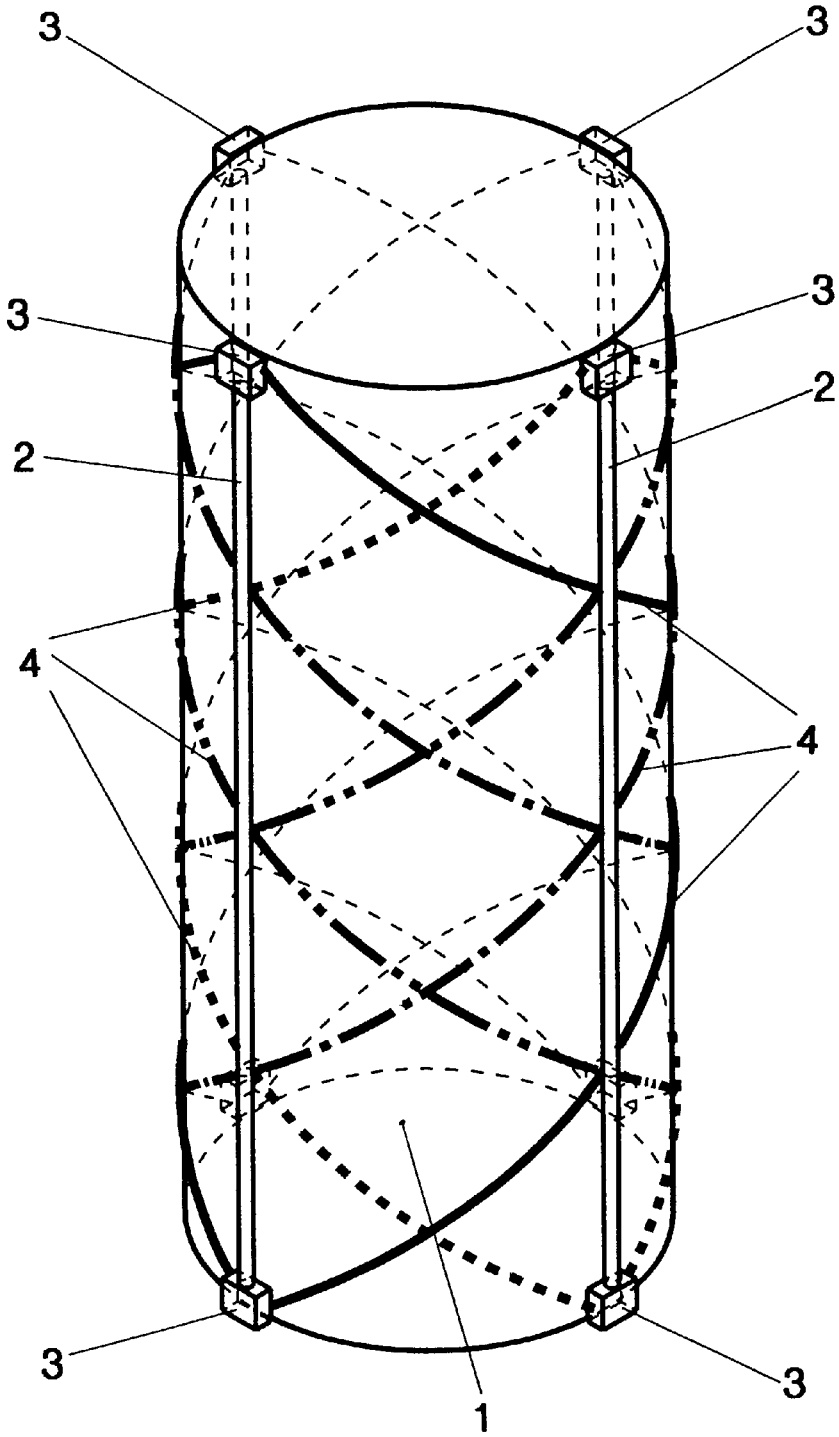

The subject of the invention is more clearly explained using the attached drawing by means of several embodiments. Shown are:

FIG. 1*a* the schematic representation of a first embodiment of a pneumatic structural component in a side view, FIG. 1*b* the subject of FIG. 1*a* in perspective, FIG. 2 a schematic representation of the forces, FIGS. 3*a, b, c* constructional details of the first embodiment FIGS. 4*a* to *e* various arrangements of tensile elements in developments, FIG. 5 a second embodiment, FIG. 6 a third embodiment, FIG. 7 an example of the application of the first embodiment, FIGS. 8*a, b, c* a fourth embodiment in three views, FIG. 9 an example of the combination of components according to FIG. 8, FIG. 10 a fifth embodiment.

Figure 1:
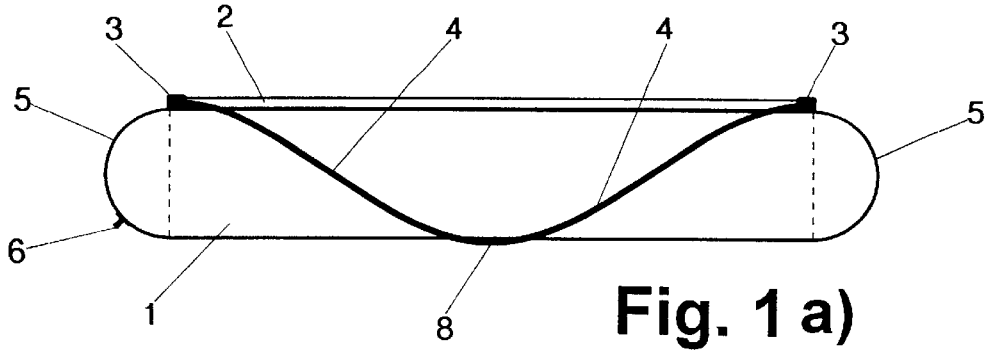
Figure 1:
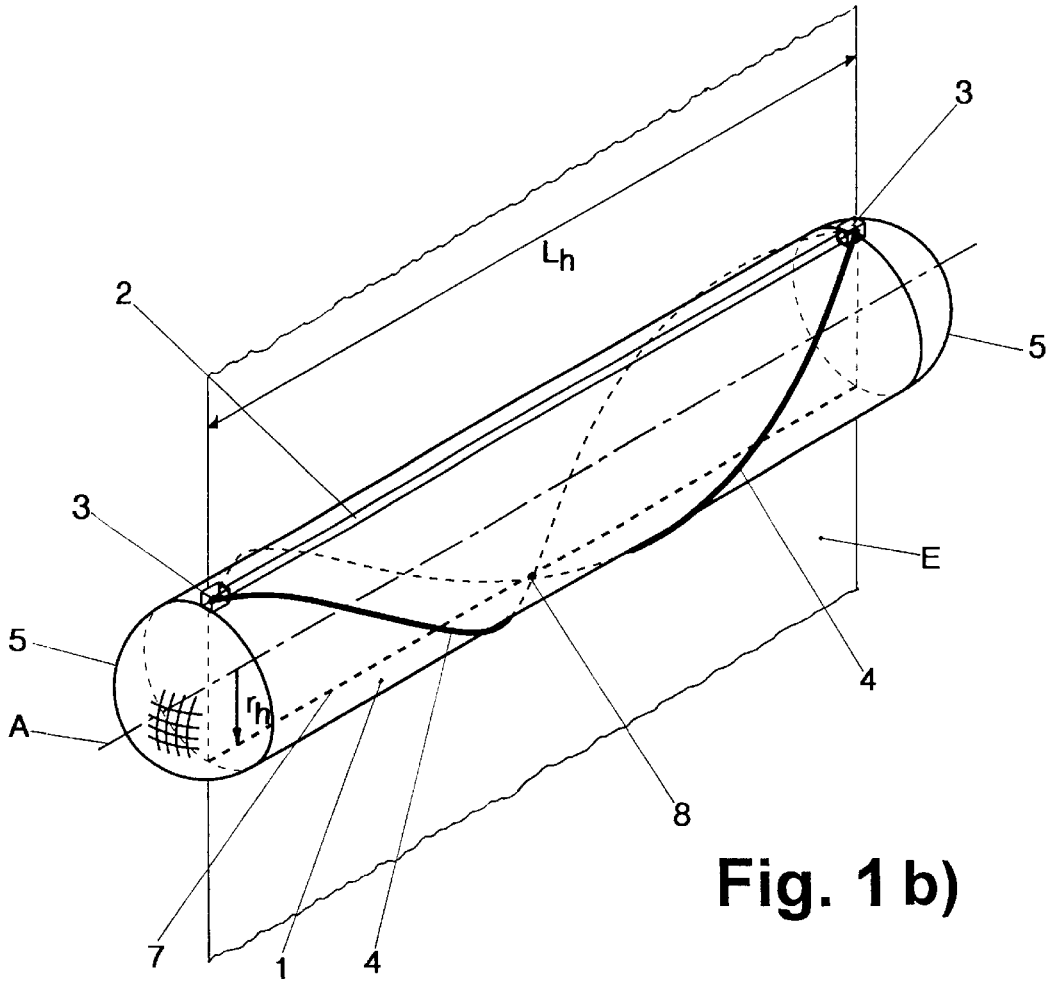

FIG. 1 is a schematic representation of a first embodiment of the inventive idea. The component shown here comprises an elongate, essentially cylindrical hollow body 1 inflated with compressed air, of length L and with a longitudinal axis A, which is manufactured from a flexible and airtight material. On its upper side a pressure rod 2 is attached which can be impacted with axial forces. Its ends are formed as nodes 3, onto which two tension elements 4 are fastened in each case. The axial ends of the hollow body 1 carry a cap 5 in each case; for instance one of these caps 5 is equipped with a valve 6 for inflating and deflating the hollow body 1.

The two tension elements 4 each embrace the hollow body 1 in the form of a screw with opposite circulating senses for instance once each with a constant pitch. They therefore intersect each other at a position 8 in the centre of a surface line 7 opposite to the pressure rod 2. The pressure rod 2 and the surface line 7 both lie on a plane of symmetry E, which similarly includes the longitudinal axis referenced A of the hollow body 1. The pressure rod 2 is attached onto the hollow body 1 such that for instance in the slack condition of the hollow body 1 it can be pushed in as is shown in FIGS. 3*a, b*. In this way it is secured against sideways buckling. Various types of construction of the nodes 3 are known and familiar to the construction engineer, so that their representation can be omitted here.

FIG. 2 shows an example of the loading of the component according to FIGS. 1*a, b*. A force $F_m$ lying in the plane of symmetry E works on the centre of the pressure rod 2. This is supported in the nodes 3. Neglecting the self weight of the component, then bearing pressures $F_A$ work on each node 3. As is known to the specialist, pure pressure forces $F_S$ are now exerted from both nodes 3 on the pressure rod 2 and pure tensile forces $F_Z$ in the tension elements 4, whereby the vector components of these tensional forces, which are perpendicular to the plane of symmetry E always compensate to null, however provide a great stiffness and buckling resistance to the component perpendicular to the plane of symmetry E. The limit loading of such a component is obtained in that the surface pressure (in $N/m^2$) of the hollow body 1 caused by the tension of the tension elements 4 must be smaller than the overpressure p acting in the hollow body 1.

FIGS. 3*a, b, c* are representations of some constructional details of the hollow body 1. In the cross section according to FIG. 3*a* the hollow body 1 is set out in separation of functions: an outer skin 10, for instance made from a woven textile assumes the force and tensile loadings. In the interior it hides an airtight tube 11 of a suitable elastomer, which is defined and maintained in form by the skin 10. There are for instance sleeves 12, 13 sewn onto the skin 10, which may be continuous or interrupted. The sleeve 13 accepts the pressure rod 2, the sleeve 12 the tension elements 4, which are set out here as flat ribbons.

In the illustration according to FIG. 3*b* the skin 10 and the tube 11 form a functional entity, which is designated pressure body 14 and for instance comprises a plastics material laminated weave, which is either sewn and sealed, welded or glued in a known manner. As a modification to the sleeves 12, 13 the pressure body 14 carries several loops 15, 16, whereby the simple loops 15 are provided for the tension elements 4, whose position is defined by its characteristic as geodetic lines, the loops 16 for the pressure rod 2 however are produced as so-called capstan loops, which loop around the pressure rod once. In the slack condition of the pressure body 14 the loops 16 are free, the pressure rod 2 can be pushed in without more ado. In the operating condition of the pressure body 14 they are however laid tightly around the pressure rod 2 and thereby prevent its sideways buckling. In accordance with the requirements which are placed upon the component, the materials used can be adapted from a wide range. For the more simple applications, textile materials such as polyester cords and weaves for the tension elements 4 and the armouring of the hollow body 1 are completely sufficient and also cost effective. For the pressure rod 2 itself, simple materials such as for instance bamboo rods can be used. Since the pressure rod 2 is well secured against sideways buckling by the sleeves 13, the pressure rod 2 can also be put together from butt jointed individual pieces.

For high loadings however, textile materials of aramid fibres and for the pressure rod 2 composite materials using carbon fibres in a suitable plastics material matrix can be provided.

The embodiments represented in FIGS. 3*a, b, c* are not limited in their features; the specialist entrusted with the solution of these details will have many further solutions available to him.

The first embodiment of the pneumatic structural component according to FIGS. 1*a, b,* 2 is preferably suited for a point load in the centre of the component or for a uniformly distributed loading. If the load distribution has to be optimised for other load application positions, then the number of the tension elements 4 can be increased. This is shown by means of FIGS. 4*a* to *e*.

FIG. 4*a* shows the embodiment of FIGS. 1*a, b* and FIG. 2 in the development of the hollow body 1. In FIG. 4*b* each tension element 4 describes two complete revolutions about the hollow body 1 and is also fastened at L/2 to the pressure rod 2. If the component according to the invention is applied as a bearing beam or an element corresponding to it, then in accordance with the embodiment in FIG. 4*b* a support is necessary at L/2. Thereby this embodiment corresponds to that in FIG. 4*a* over half L.

The embodiment according to FIG. 4*c* is an overlay of that according to FIGS. 4*a* and *b* with regard to the tension elements 4. Since the hollow body 1 is supported by the tension elements 4 as in FIG. 4*a* at L/2, no central support is required here. Furthermore the preference for point loading at L/2 also disappears.

In the embodiment according to FIG. 4*d* three pairs of tension elements 4 are applied; the component is thereby suited for line loading. At the positions 8 where the tension elements 4 intersect, they are mutually secured against movement. FIG. 4*e* shows the application of two pairs of parallel mutually parallel tension elements 4. The tension elements 4 not terminating at the ends of the pressure rod 2 are also secured in node elements. This embodiment also emphasises the preference for point loading at L/2.

Two embodiments in the form of non-cylindrical hollow bodies 1 are shown in FIGS. 5, 6. That in FIG. 5 has a toroidal hollow body 1; the associated pressure rod 2 is then for instance arc shaped.

The embodiment according to FIG. 6 is a double cone with for instance arc shaped surface lines. Obviously hollow bodies 1 shaped as a truncated cone are included in the inventive idea.

The tension elements of the embodiment according to FIGS. 5, 6 are arranged analog to FIGS. 1, 2. Obviously all the embodiments according to FIG. 4*a* to *e*, suitably adapted here, are similarly in accordance with the invention.

FIG. 7 is the representation of an embodiment of the pneumatic structural component according to the invention as in FIGS. 1, 2. Several, for instance five, of such components are joined together into a bridge 18. At each end of this bridge 18 a yoke 19 joins together all the nodes 3 on one side of the bridge and directs the applied force $F_A$ into the components. The yoke 19 is shown transparent in FIG. 7 with all the technical details omitted, since the construction of such yokes 19 is known to the specialist.

Over the components, comprising hollow bodies 1, pressure rods 2 and tension elements 4, wooden planks 20, for instance, are laid at right angles to them and in a known manner joined to each other and to the pressure rods 2. The other end, not shown, of the bridge 18 is constructed in a similar manner. Obviously other known types of decking cover are possible for the bridge, such as perforated steel or other suitable forms and materials.

Similarly not shown—since they are state of the art—are the valves 6 and the necessary manifold for simultaneous and pressure equalising inflation of the hollow bodies 1.

FIG. 8 is the representation of a further embodiment of the inventive idea. FIG. 8*a* shows a side view, FIG. 8*b* a plan view and FIG. 8*c* a cross section. The hollow body 1 including the various manufacturing modifications is constructed in the same way as that according to FIG. 1. The embodiment according to FIG. 8 has however two pressure rods 2 attached at the sides. Each pressure rod 2 carries a node 3 at each end for the positive engagement of the pressure rod 2 and the tension elements 4. Although with the same diameter of the hollow body 1 its effective height is reduced, at the same time the component according to FIG. 8 (referenced with the reference 22) is however in a position to accept positive and negative bending moments. The reduced maximum load capacity could, if necessary, obviously be compensated for by the choice of a greater diameter for the hollow body 1. The fastening of the pressure rods 2 to the hollow body 1 is effected using analog or identical means as in the first embodiment according to FIGS. 1, 2. Otherwise the statements on FIGS. 4*a–e* regarding the tension elements apply also for the embodiment according to FIG. 8.

In FIG. 9 an embodiment is shown of a combination of components 22 according to FIG. 8. A multiplicity of such components 22 is arranged adjacent to each other. Each pressure rod 2 accepts the pressure force resulting from the loading of the component 22 in the direction of the vector arrow (loading force $F_L$) in FIG. 9 of two adjacent components 22. For the acceptance of a pressure rod 2 the walls of two adjacent hollow bodies 1 are joined together along two surface lines—by sewing, gluing or welding—whereby a longitudinal running pocket 21 occurs. By the inflation of the hollow bodies 1 the pressure rods 2 pushed into the pockets 21, still slack at first, are clamped between the hollow bodies 1 and are secured against buckling in both directions. With such an arrangement it is possible to create a lightweight roof of great span width, which additionally has the great advantage that both snow loading and lifting wind forces can be withstood.

It is further included in the inventive idea to provide the embodiment shown in FIGS. 5, 6 with two pressure rods 2 according to FIG. 8. Furthermore such modified components according to FIGS. 5 and 8 can also be joined together according to FIG. 9. A convex arched roof can be realised thereby; by changing the radius of curvature of the components according to FIGS. 5 and 8 and modification of their length a cupola can be created.

FIG. 10 shows a further embodiment of the inventive idea. Here, four pressure rods 2 are arranged at regular spacing around the cylindrical hollow body 1. Each pressure rod 2 has again at each end a node 3, into which for instance two tension elements 4 are fastened in each case. For greater clarity in FIG. 10 each pair of tension elements associated with a pressure rod 2 is given the same signatures. The pressure rods 2 are secured against buckling in the azimuthal direction of the cylindrical hollow body 1 and against radial buckling outwards by sleeves (analog to the sleeves 13 according to FIG. 3), and against radial buckling inwards by the excess of pressure in the hollow body 1. In this way an extraordinarily light and axially highly loadable component arises. By suitable and well known means it can be ensured that the axial pressure load on all four pressure rods is evenly distributed.

What is claimed is:

1. A pneumatic structural component comprising an airtight elongate hollow body of flexible material which can be inflated by compressed air, at least one pressure rod, and at least one pair of tension elements, wherein the at least one pressure rod lies onto the hollow body along a surface line and is secured against displacement and buckling by sleeve type elements, wherein the at least one pair of tension elements are fastened at both ends of the at least one pressure rod, for which purpose the pressure rod has a node for fastening the pressure rod and the tension elements with mutual positive engagement, wherein the at least two tension elements are each laid in the form of a screw contra-rotating around the hollow body and intersect each other on a surface line of the hollow body opposite to the pressure rod, and wherein the nodes are adapted to accept bearing pressure.

2. A pneumatic structural component according to claim 1, wherein the hollow body comprises an airtight laminated tensile weave and has at least one valve for inflation and deflation.

3. A pneumatic structural component according to claim 1, wherein the hollow body comprises a tensile weave which forms an outer skin, further comprising an airtight tube of an elastomer inserted in the outer skin, with at least one valve for inflation and deflation.

4. A pneumatic structural component according to claim 2 or claim 3, wherein exactly one pressure rod is present comprising at least one piece, which runs along a surface line of the hollow body and wherein the nodes at its ends are adapted to accept bearing forces transversal and at right angles through the longitudinal axis of the hollow body.

5. A pneumatic structural component according to claim 4, wherein exactly one pair of tension elements is present and is joined to the pressure rod with positive engagement, whereby the tension elements each describes in contrary sense a whole number of circuits around the hollow body.

6. A pneumatic structural component according to claim 5, wherein the tension elements each describe one circuit around the hollow body.

7. A pneumatic structural component according to claim 4, wherein exactly two pairs of tension elements are present and joined to the nodes in positive engagement with the pressure rods, whereby each pair of tension elements describes a whole number of circuits around the hollow body.

8. A pneumatic structural component according to claim 7, wherein one pair of tension elements describes exactly one circuit and the other pair of tension elements exactly two circuits around the hollow body.

9. A pneumatic structural component according to claim 4, comprising more than two pairs of tension elements joined to the nodes in positive engagement, whereby each pair of tension elements describes a whole number of circuits around the hollow body.

10. A pneumatic structural component according to claim 2 or claim 3, comprising exactly two pressure rods, which are fastened along two opposing surface lines of the hollow body against buckling, and wherein the nodes are adapted to join each pressure rod with the pair of tension elements associated with them in positive engagement and are adapted to accept transverse bearing forces whereby these bearing forces are at right angles to a plane (E) in which the pressure rods and the longitudinal axis of the hollow body lie.

11. A pneumatic structural component according to claim 10, wherein the hollow body has an essentially cylindrical form.

12. A pneumatic structural component according to claim 11, comprising for each pressure rod exactly one pair of tension elements joined in the nodes in positive engagement with the associated pressure rod, whereby the tension elements each describe a whole number of circuits around the hollow body.

13. A pneumatic structural component according to claim 11, comprising for each pressure rod more than one pair of tension elements joined with positive engagement in the associated nodes, whereby each pair of tension elements describes a whole number of circuits around the hollow body.

14. A pneumatic structural component according to claim 10, wherein the hollow body is essentially in the form of a torus.

15. A pneumatic structural component according to claim 14, comprising for each pressure rod more than one pair of tension elements joined with positive engagement in the associated nodes, whereby each pair of tension elements describes a whole number of circuits around the hollow body.

16. A pneumatic structural component according to claim 10, wherein the hollow body is conically formed at least on one side.

17. A pneumatic structural component according to claim 16, comprising for each pressure rod more than one pair of tension elements joined with positive engagement in the associated nodes, whereby each pair of tension elements describes a whole number of circuits around the hollow body.

18. A pneumatic structural component according to claim 2 or claim 3, comprising exactly four pressure rods fastened against buckling to the hollow body along surface lines lying apart from each other by 90°, and at least one pair of tension elements per pressure rod joined with positive engagement in the nodes of this pressure rod, wherein each pair of tension elements has a whole number of turns about the hollow body, and wherein the nodes are also adapted to accept forces running axially to the hollow body.

* * * * *

UNITED STATES PATENT AND TRADEMARK OFFICE

CERTIFICATE OF CORRECTION

PATENT NO. : 6,543,730 B2
DATED : April 8, 2003
INVENTOR(S) : Mauro Pedretti

It is certified that error appears in the above-identified patent and that said Letters Patent is hereby corrected as shown below:

Title page,
Item [57], ABSTRACT,
Line 1, replace "The pneumatic" with -- A pneumatic --
Line 5, replace "to the loading carries" with -- to loading carries --
Line 14, replace "which the engaging loads" with -- which engaging loads --

Signed and Sealed this

Fourth Day of November, 2003

JAMES E. ROGAN
*Director of the United States Patent and Trademark Office*